US006460309B1

(12) United States Patent
Schneider

(10) Patent No.: US 6,460,309 B1
(45) Date of Patent: Oct. 8, 2002

(54) BEAM ROOFING SYSTEM AND METHOD

(76) Inventor: Dale Schneider, 1071 Firestone Pkwy., La Vergne, TN (US) 37086

( * ) Notice: Subject to any disclaimer, the term of this patent is extended or adjusted under 35 U.S.C. 154(b) by 0 days.

(21) Appl. No.: 09/488,484

(22) Filed: Jan. 20, 2000

(51) Int. Cl.[7] ..... E04C 3/30

(52) U.S. Cl. ..... 52/729.1; 52/730.4; 52/732.1; 52/90.1; 52/DIG. 17

(58) Field of Search ..... 52/729.1, 90.1, 52/200, 220.2, 395, 465, 469, 555, 640, DIG. 17, 220.1, 730.4, 731.2, 732.1, 198, 745.06

(56) References Cited

U.S. PATENT DOCUMENTS

| | | | | | |
|---|---|---|---|---|---|
| 1,931,750 | A | * | 10/1933 | Blaski | 52/90.1 |
| 2,947,040 | A | | 8/1960 | Schultz | 20/4 |
| 3,055,461 | A | | 9/1962 | De Ridder | 189/34 |
| 3,096,861 | A | | 7/1963 | Frick et al. | 189/34 |
| 3,340,657 | A | | 9/1967 | Thomas | 52/210 |
| 3,345,794 | A | | 10/1967 | Proud | 52/731 |
| 3,457,698 | A | * | 7/1969 | Albers | 52/225 |
| 3,562,992 | A | | 2/1971 | Kinsey | 52/588 |
| 3,733,756 | A | | 5/1973 | Butler | 52/36 |
| 3,760,544 | A | | 9/1973 | Hawes et al. | 52/468 |
| 3,798,869 | A | * | 3/1974 | Nipp | 52/579 |
| 3,805,470 | A | | 4/1974 | Brown | 52/400 |
| 3,848,387 | A | | 11/1974 | Hafner | 52/735 |
| 3,875,715 | A | * | 4/1975 | Martin et al. | 52/309 |
| 3,952,461 | A | | 4/1976 | Kinsey | 52/57 |
| 3,978,629 | A | | 9/1976 | Echols, Sr. | 52/235 |
| 4,040,219 | A | | 8/1977 | Budich | 52/209 |
| 4,057,941 | A | | 11/1977 | Schwartz | 52/63 |
| 4,069,627 | A | | 1/1978 | Pegg | 52/92 |
| 4,110,942 | A | | 9/1978 | Slocomb, Jr. | 52/100 |
| 4,167,838 | A | | 9/1979 | Metheny | 52/79.5 |
| 4,173,855 | A | * | 11/1979 | Raptoplous | 52/82 |
| 4,426,814 | A | * | 1/1984 | Stuhmer | 52/82 |
| 4,583,333 | A | | 4/1986 | Minter | 52/90 |
| 4,594,828 | A | | 6/1986 | Taylor | 52/282 |
| 4,601,139 | A | | 7/1986 | Esposito | 52/90 |
| 4,724,646 | A | | 2/1988 | Meyers | 52/66 |
| 4,745,723 | A | | 5/1988 | Esposito | 52/464 |
| 4,765,102 | A | | 8/1988 | Kuchem | 52/28 |
| 4,773,193 | A | | 9/1988 | Biebuyck et al. | 52/93 |
| 4,796,395 | A | | 1/1989 | Israel | 52/86 |
| 4,884,376 | A | | 12/1989 | DeBlock et al. | 52/90 |
| 4,903,455 | A | | 2/1990 | Veazey | 52/822 |
| 4,918,882 | A | | 4/1990 | Funk | 52/86 |
| 5,003,733 | A | | 4/1991 | Strobl, Jr. et al. | 52/86 |
| 5,007,215 | A | | 4/1991 | Minter | 52/90 |
| 5,046,791 | A | | 9/1991 | Kooiman | 312/265.1 |
| 5,090,164 | A | | 2/1992 | Mische | 52/90 |
| 5,125,207 | A | | 6/1992 | Strobl, Jr et al. | 52/747 |
| D327,744 | S | | 7/1992 | Francis | D25/1 |
| 5,197,241 | A | * | 3/1993 | Romeo et al. | 52/82 |
| 5,197,253 | A | | 3/1993 | Johnson | 52/646 |
| 5,293,728 | A | | 3/1994 | Christopher et al. | 52/588.1 |
| 5,325,647 | A | | 7/1994 | Forry et al. | 52/309.15 |
| 5,363,615 | A | | 11/1994 | Christopher et al. | 52/272 |
| 5,394,664 | A | | 3/1995 | Nowell | 52/200 |
| 5,555,681 | A | | 9/1996 | Cawthon | 52/63 |
| 5,560,155 | A | | 10/1996 | Back | 52/90.1 |
| 5,568,707 | A | | 10/1996 | Ishikawa et al. | 52/200 |
| 5,608,997 | A | | 3/1997 | Mahowich | 52/233 |
| 5,771,640 | A | | 6/1998 | Back | 52/90.1 |
| 5,783,286 | A | | 7/1998 | DiNicola | 428/188 |
| 5,792,529 | A | | 8/1998 | May | 428/36.2 |
| 5,848,512 | A | * | 12/1998 | Conn | 52/729.1 |
| 6,003,279 | A | * | 12/1999 | Schneider | 52/481.1 |
| 6,189,269 | B1 | * | 2/2001 | DeZen | 52/220.5 |

FOREIGN PATENT DOCUMENTS

| | | | | |
|---|---|---|---|---|
| GB | 2177436 | * | 7/1986 | 52/82 |

* cited by examiner

*Primary Examiner*—Carl D. Friedman
*Assistant Examiner*—Naoko Slack
(74) *Attorney, Agent, or Firm*—David B. Pieper; Waddey & Patterson

(57) ABSTRACT

A roofing apparatus for forming round, square, and oval rooms utilizing channel beams and interlocking roof panels. A system and method for utilizing vinyl as a construction material for forming roofing system is taught along with the use of connecting spiders, connection blocks, and insulated and sheathed vinyl panels. The system teaches the use of a non-thermally conductive I-beam for forming a roof system for improved insulation and long-term longevity of building structures.

17 Claims, 18 Drawing Sheets

BEAM ROOFING SYSTEM AND METHOD

BACKGROUND OF THE INVENTION

The present invention relates generally to roofing systems for buildings and sunroom additions to homes. More particularly, this invention pertains to a method and apparatus for constructing a roof from an extruded material for improved thermal characteristics and stability.

FIG. 1 of the drawings shows a prior art profile of a metal I-beam 10. The design utilizes a top planar member 12, a vertical planar member 14, and a bottom planar member 16. While the metal I-beam 10 design is well recognized in standard construction techniques and assemblies, This design is limited in its functionality and effective utilization of materials.

Prior art disclosures are found in a multitude of U.S. Pat. Nos. including 2,947,040 issued to Schultz on Aug. 2, 1960; 3,055,461 issued to Ridder on Sep. 25, 1962; 3,096,861 issued to Frick et al. on Jul. 9, 1963; 3,340,657 issued to Thomas on Sep. 12, 1967; 3,345,794 issued to Proud on Oct. 10, 1967; 3,562,992 issued to Kinsey on Feb. 16, 1971; 3,733,756 issued to Butler on May 22, 1973; 3,760,544 issued to Hawes et al. on Sep. 25, 1973; 3,805,470 issued to Brown on Apr. 23, 1974; 3,848,387 issued to Hafner on Nov. 19, 1974; 3,952,461 issued to Kinsey on Apr. 27, 1976; 3,978,629 issued to Echols, Sr. on Sep. 7, 1976; 4,040,219 issued to Budich on Aug. 9, 1977; 4,057,941 issued to Schwartz on Nov. 15, 1977; 4,069,627 issued to Pegg on Jan. 24, 1978; 4,110,942 issued to Slocomb, Jr. on Sep. 5, 1978; 4,167,838 issued to Metheny on Sep. 18, 1979; 4,583,333 issued to Minter on Apr. 22, 1986; 4,594,828 issued to Taylor on Jun. 17, 1986; 4,601,139 issued to Esposito on Jul. 22, 1986; 4,724,646 issued to Meyers on Feb. 16, 1988; 4,745,723 issued to Esposito on May 24, 1988; 4,765,102 issued to Kuchem on Aug. 23, 1988; 4,773,193 issued to Biebuyck et al. on Sep. 27, 1988; 4,796,395 issued to Israel on Jan. 10, 1989; 4,884,376 issued to DeBlock et al. on Dec. 5, 1989; 4,903,455 issued to Veazey on Feb. 27, 1990; 4,918,882 issued to Funk on Apr. 24, 1990; 5,003,733 issued to Strobl, Jr. et al. on Apr. 2, 1991; 5,007,215 issued to Minter on Apr. 16, 1991; 5,046,791 issued to Kooiman on Sep. 10, 1991; 5,090,164 issued to Mische on Feb. 25, 1992; 5,125,207 issued to Strobl, Jr. et al. on Jun. 30, 1992; 5,197,253 issued to Johnson on Mar. 30, 1993; 5,293,728 issued to Christopher et al. on Mar. 15, 1994; 5,325,647 issued to Forry et al. on Jul. 5, 1994; 5,363,615 issued to Christopher et al. on Nov. 15, 1994; 5,394,664 issued to Nowell on Mar. 7, 1995; 5,555,681 issued to Cawthon on Sep. 17, 1996; 5,560,155 issued to Back on Oct. 1, 1996; 5,568,707 issued to Ishikawa et al. on Oct. 29, 1996; 5,608,997 issued to Mahowich on Mar. 11, 1997; 5,771,640 issued to Back on Jun. 30, 1998; 5,783,286 issued to DiNicola on Jul. 21, 1998; 5,792,529 issued to May on Aug. 11, 1998; Design Patent Des. 327,744 issued to Francis on Jul. 7, 1992; and Swiss Patent No. 459 516. These patents are hereby incorporated by reference.

A representative number of these patents will be reviewed in the following discussion:

U.S. Pat. No. 3,760,544 issued to Hawes et al. on Sep. 25, 1973, discloses a SEALING GASKET WITH ELONGATED INTERNAL STIFFENER. This specification is directed towards an extruded plastic gasket which is constructed with a full length of strip or insert of a different material in the gasket. This inner material is utilized to strengthen the portion of the gasket in which it is located and reduce any creeping or other movement of the gasket after it has been installed.

U.S. Pat. No. 3,952,461 issued to Kinsey on Apr. 27, 1976, discloses MULTI-LAYER WALLS FOR FRAMELESS BUILDINGS FORMED FROM EXTRUDED ALUMINUM OR PLASTIC INTERLOCKING WALL ELEMENTS. FIG. 20 of this application describes the use of a sub-comb having upwardly facing, angularly disposed surfaces for engaging and supporting the upper ends of the metallic roof rafters. As noted by the remainder of the specification, the specification is directed towards a multi-layer wall structure which utilizes so extruded wall elements to interlock and form a frameless multi-story building complex.

U.S. Pat. No. 4,601,139 issued to Esposito on Jul. 22, 1986, discloses a METHOD AND FRAMEWORK FOR A GREENHOUSE OR THE LIKE INCLUDING A REVERSIBLE GABLE ADAPTER. As noted in FIG. 8 of the drawings, wedge-shaped adapters is utilized to join vertical bars with sloped bars. This adapter is inserted into a chamber using the prong of the adapter.

U.S. Pat. No. 5,046,791 issued to Kooiman on Sep. 10, 1991, discloses an Extrusion Frame and Components Therefor. This specification is directed towards the framing of cabinetry and the like which utilizes a connecting element for joining extrusion frame components.

U.S. Pat. No. 5,325,647 issued to Forry et al. on Jul. 5, 1994, discloses a Composite Ceiling Grid. This specification is directed towards ceiling grid runners and the associated method of assembly which utilizes metal reinforced thermal plastic compounds. This system utilizes the metal in strategically positioned areas to maximize the strength ratio of the plastic.

U.S. Pat. No. 5,555,681 issued to Cawthon on Sep. 17, 1996, discloses a Modular Building System. This specification is directed towards the construction of various light structures. An octagonal cap is described which may be separated to serve as an Apex for a quarter-end structure for a shed like addition. As shown in FIG. 13 of the drawings, a roof ridge member may be used to form the roof ridge or crest of a gabled structure.

U.S. Pat. No. 5,792,529 issued to May on Aug. 11, 1998, discloses a Reinforced Plastic Extrusion. This specification describes the use of three different extrusions in order to form a single configuration with increased components strength and stiffness. Thus, the desired profile is extruded which allows for the strategic placement within a profile to obtain optimum strength and stiffness.

Prior art aluminum roofing systems for additions or sunrooms are well known. These sunrooms pose certain problems during their life. Aluminum works as an excellent heat conductor as evidenced by its use in a variety of heat dissipation applications. However, this high thermal conductivity causes several problems in roofing systems. Aluminum roofing systems transfer cold from the outside of a structure to the interior environment. This heat transfer can lead to condensation on the interior roof of the structure, and the transfer of interior heat to the outside environment results in thermal inefficiencies. In addition, aluminum structures are rigid and may dent, scratch, or be punctured due to contact with normal everyday items such as lawn mower, foot traffic, or wind blown debris. Thus, the present art of aluminum roof construction has several disadvantages. can lead to condensation on the interior roof of the structure, and the transfer of interior heat to the outside environment results in thermal inefficiencies. In addition, aluminum structures are rigid and may dent, scratch, or be punctured due to contact with normal everyday items such as lawn mower, foot traffic, or wind blown debris. Thus, the present art of aluminum roof construction has several disadvantages.

Thus, the prior art patents teach limited structures which pose problems for temperature variations, normal wear and tear associated with buildings, and long term stability. What is needed, then, is an improved method and apparatus for constructing buildings with increased efficiency.

SUMMARY OF THE INVENTION

The present invention is directed towards a vinyl roofing system utilizing beams to inter-connect roof panels with a roof cap for providing a roof structure. The system may utilize a connecting spider for forming rounded roofing systems, and an upper and lower roof cap for connecting the roofing system together. The system may utilize channel beams with top and bottom plates with a plurality of vertical members to form a center aperture. This center aperture may be utilized with a beam filler, and may also be utilized as a raceway for electrical, water, or other connections within the structure. A further embodiment of the present invention utilizes channel V-beams to form a rounded roofing system for efficient roofing construction and methods. These beams may utilize end caps for completing the structural appearance and integrity of the building.

Different connecting blocks and means are taught for connecting the various rafters together. Different panels including vinyl sheathing panels, insulated and polycarbonate panels, as well as polycarbonate panels are taught in the present invention which may utilize fascia caps for protecting the ends of the panels, or the sheathing may wrap over edges to cover adjacent surfaces of the roofing panels.

DESCRIPTION OF THE PREFERRED EMBODIMENTS

The present invention is directed towards a new apparatus and method for building and roof construction utilizing individual members which are interconnected to form the desired structure. Each of these members will be described in detail, and then the combination of the members to form structures will also be described for the varying embodiments.

Figure 1:
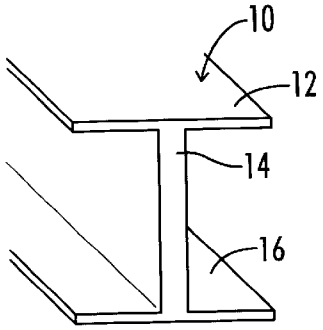
FIG. 1 (Prior Art)
FIG. 1 shows a prior art I-beam profile.
Figure 2:
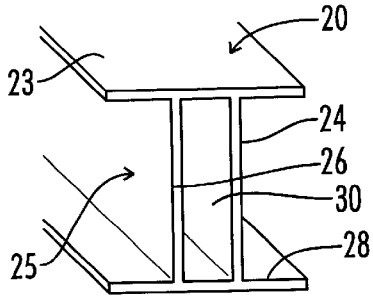
FIG. 2 of the drawings shows a channel I-beam.
Figure 3:
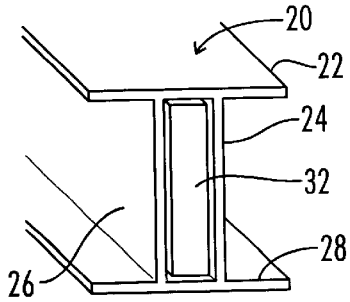
FIG. 3 of the drawings shows a channel I-beam with a filler insert.

While the I-beam 10 profile of FIG. 1 may be used for certain positions in building structures, a typical I-beam is limited in application due to its basic structure. Thus, the preferred embodiment of this invention utilizes a different configuration for the beams that are used in constructing a roofing apparatus. FIGS. 2 and 3 show one preferred embodiment of the channel beam apparatus as utilized in the present invention. This channel beam apparatus 20 is a channel I-beam 21 which includes a top structure 22, a plurality of vertical members 25 engaging the top structure 22, and a bottom structure 28 engaging the plurality of vertical members 25. The plurality of vertical members 25 is shown as separate vertical members 24 and 26. It is also envisioned that the plurality of vertical members 25 could include more than two vertical members for constructing various configurations of the channels beams 20. Each of the vertical members 24 and 26 is inwardly disposed from the outer edges of the top structure 22 to form a central aperture 30.

The channel beam 20 is preferably constructed from an extruded vinyl with degradation inhibitors for weather and sunlight, including ultraviolet light exposure. Vinyl compositions are well known for outdoor exposures and thus, will not be described in further detail.

Figure 4:
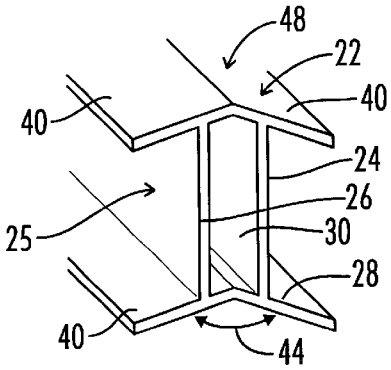
FIG. 4 of the drawings shows a pointed channel V-beam.
Figure 5:
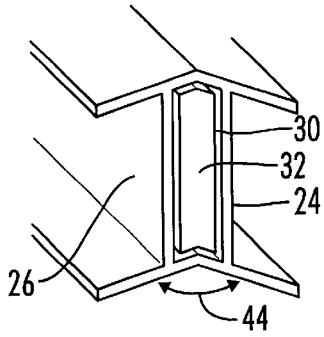
FIG. 5 of the drawings shows a pointed channel V-beam with filler insert.
Figure 6:
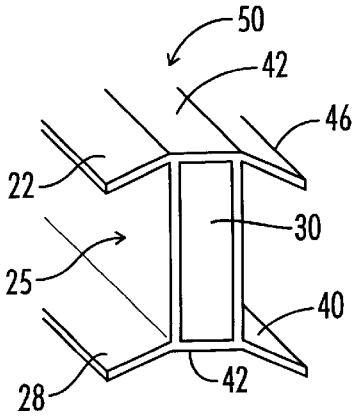
FIG. 6 of the drawings shows a flat top channel V-beam.
Figure 7:
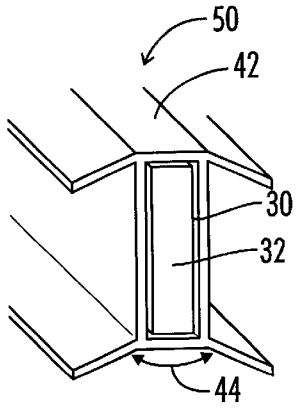
FIG. 7 of the drawings shows a flat top channel V-beam with filler insert.

The top structure 22 and bottom structure 28 may be formed as a flat planar structure 23 as shown in FIGS. 2 and 3, or may be formed in a more complex configuration as shown in FIGS. 4 through 10. The more complex configurations for the top structure 22 and bottom structure 28 utilize wings 40 that may be directly connected to each other as shown in FIGS. 4 and 5, or may utilize a connection to an aperture base 42 as shown in FIGS. 6 and 7. These wings 40 are angled in a wing angle 44 to form the general shape of a pointed or flat bottom upper V for the top structure 22 and a pointed or flat bottom lower V for the bottom structure 28.

These angles 44 maybe formed so that the wing angle 44 allows for forming a central roof rafter, curved wall studs, finishing edges for panels, or a curved roof structure. One preferred embodiment utilizes a wing angle 44 of 135 degrees. This allows for the formation of curved buildings with 45 degree angling between each panel around the curve. The drawings show a steep wing angle 44 to emphasize the wing angle 44 for illustrative purposes.

The open space between the plurality of vertical members 25 forms a central aperture 30. The plurality of vertical members 25 is generally formed as parallel planar structures 24 and 26 between the top structure 22 and bottom structure 28, although it is envisioned that deviations from the parallel planar construction could be utilized for varying embodiments of the channel beams 20.

The central aperture 30 may be utilized as a utility run for installing electrical cables, water pipes, gas lines, or other connections as required in the construction process. A beam filler 32 may be placed within the central aperture 30 to add strength, insulation properties for use as a connecting base for screws, or for other purposes. The preferred beam filler 32 is a compressed wood product with laminated wood layers which adds strength and insulation properties to the channel beam 22 as well as providing a solid base for screw installation.

Each of the various configurations of the beam elements, including the top structure 22, plurality of vertical members 25, and bottom structure 28 form different types of beams.

FIG. 4 shows a pointed channel V-beam configuration 48. The pointed channel V-beam 48 utilizes a plurality of vertical members 25, a pointed V top structure 22, and pointed V bottom structure 28. FIG. 5 shows the pointed channel V-beam 48 with a filler 32 in the central aperture 30.

FIG. 6 shows the channel flat bottom V-beam 50. The flat bottom channel V-beam 50 utilizes a plurality of vertical members 25, a flat bottom V top structure 22, and flat bottom V bottom structure 28. FIG. 7 shows the flat bottom channel V-beam 50 with a filler 32 in the central aperture 30.

Figure 8:
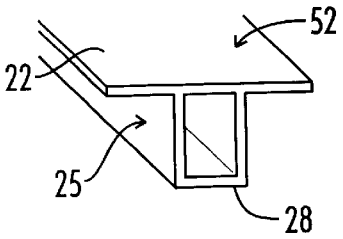
FIG. 8 of the drawings shows a channel T-beam.

FIG. 8 of the drawings shows another possible configuration of a channel beam 20 as a channel T-beam 52. The channel T-beam 52 utilizes a plurality of vertical members 25, a planar bottom structure 28, and a planar top structure 22. The channel T-beam 52 may be formed by machine the lower wings 40 from the channel I-beam 20. This allows for one extrusion to be made and then machined when necessary for installation. The machining of the wings 40 from the other styles of the channel beams may also be performed to obtain different shapes as called for in the construction process.

Figure 9:
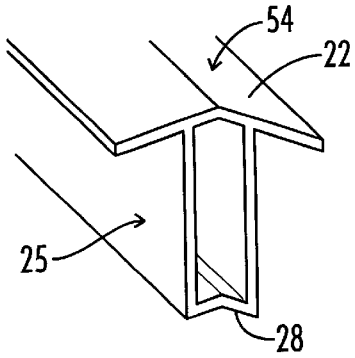
FIG. 9 of the drawings shows a pointed channel arrow beam.

FIG. 9 shows a pointed channel arrow-beam 54 which utilizes a plurality of vertical members 25, a pointed V top structure 22, and wingless pointed V bottom structure 28.

Figure 10:
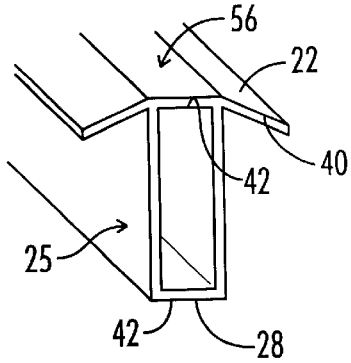
FIG. 10 of the drawings shows a flat top channel arrow beam

FIG. 10 shows the channel flat bottom V-arrow-beam 56. The flat bottom V channel arrow-beam 56 utilizes a plurality of vertical members 25, a a flat bottom V top structure 22, and an aperture base 42 bottom structure 28.

Figure 11:
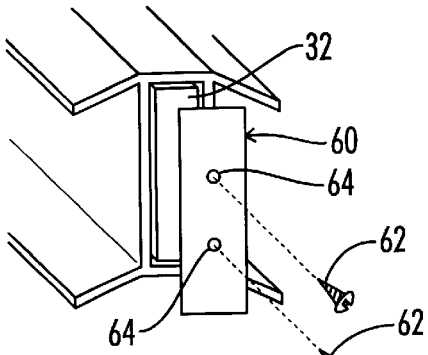
FIGS. 11–19 of the drawings shows various configurations for end caps for the different profile configurations of the beams.

FIGS. 11 through 19 show various configurations of end caps 60 for covering the center aperture 30 and covering the end of the various configurations of the channel beams 20. These end caps 60 are also known as retainer caps 60. As shown in FIG. 11, the retainer caps 60 may be attached to the filler 32 in the center aperture 30 through the use of screws 62 which pass through attachment holes 64 in the end caps. Alternative methods for attachment, including clip-on-caps, friction-engagement caps, and glue or adhevisely held caps are also envisioned.

Figure 12:
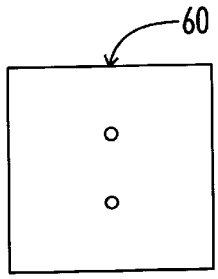
Figure 13:
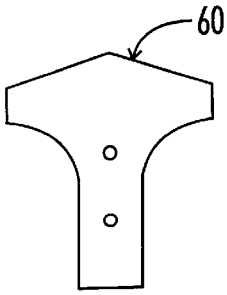
Figure 14:
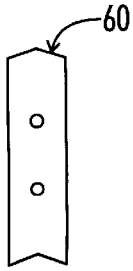
Figure 15:
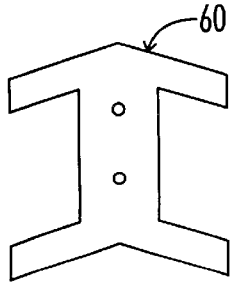
Figure 16:
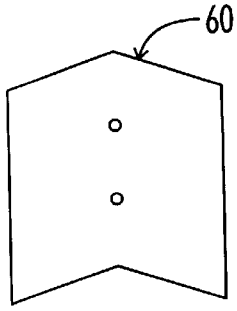
Figure 17:
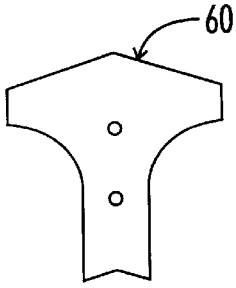
Figure 18:
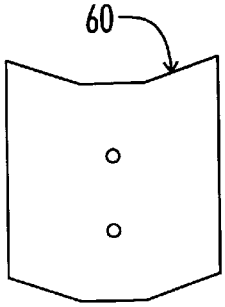
Figure 19:
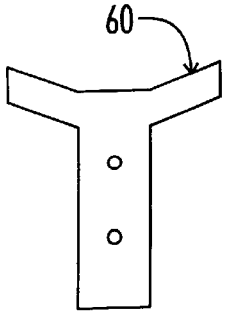

FIG. 11 shows a simple center aperture cover 60 designed only to cover the aperture 30 itself. FIG. 12 shows a complete end cover 60 for the channel I-Beams 20 shown in FIGS. 2 and 3. The end cap 60 shown in FIG. 13 may be used to cover the end of a channel T-beam 52 as shown in FIG. 8. FIG. 14 shows the end cover 60 for the center aperture of any of the pointed V style of beams. FIGS. 15 through 17 show additional embodiments that may be utilized for covering additional portions of the pointed V style of beams. FIGS. 18 and 19 show curved end caps 60 that may be used for covering the angled end where the adjoining roof panels form an angle on a circular or oval style of room construction. These end caps 60 fit the angle formed on the end of the roof rafters necessary to form the curved roof line at the wall stud top plate.

Figure 20:
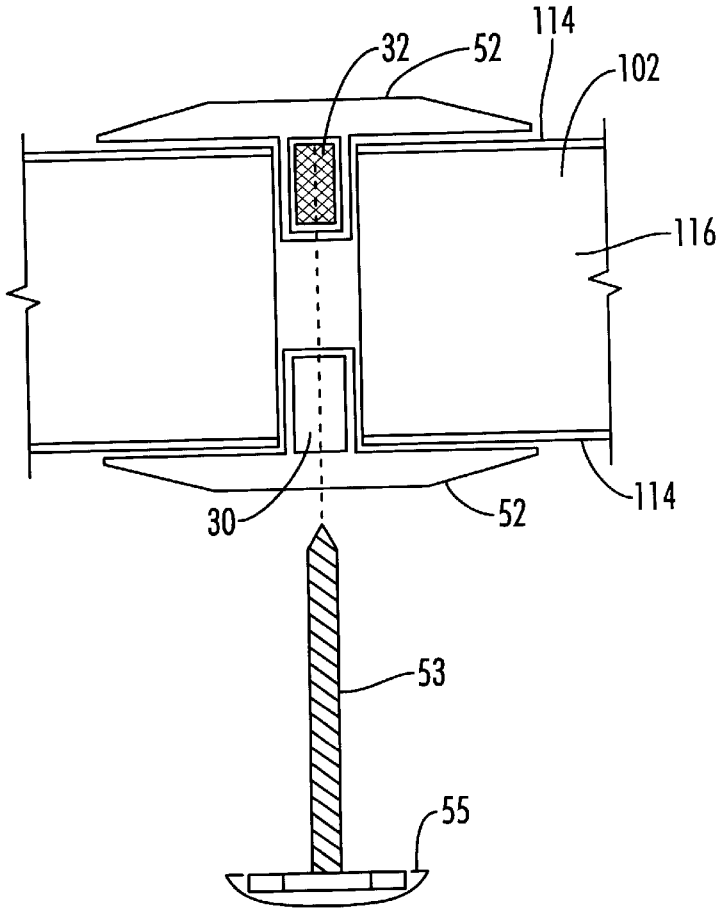
FIG. 20 of the drawings shows the interconnection of two channel T-beams for extended thickness insulated roof panels with the channel beams.

FIG. 20 of the drawings shows the interconnection of two channel T-beams 52 for extended thickness insulated roof panels 102 with the channel T-beams 52. A first channel T-beam 52 is placed on top of the insulated panels 102 and a filler 32 is inserted into the aperture 30 of the first channel T-beam 52. A second channel T-beam 52 is placed under the insulated panels 102. The first and second channel T-beams 52 are then joined by screws 53 which are driven through the second channel T-beam 52 and into the filler 32 in the first channel T-beam 52. This connection method allows for varying sizes of roofing materials to be utilized by changing the length of screw 53 that is used to connect the first and second channel T-beams. For a finished look, a screw cap 55 may be placed over the head of the screw 53. The construction of the insulated panels is discussed infra.

Figure 21:
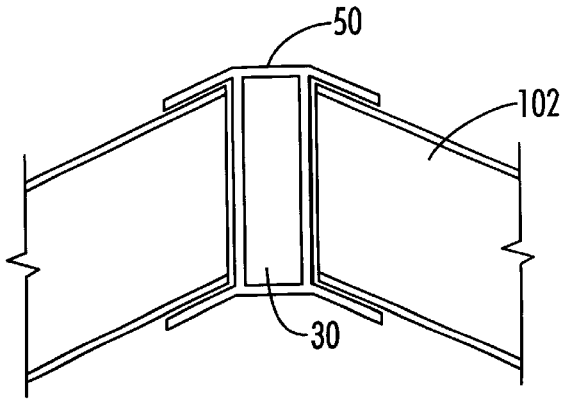
FIG. 21 of the drawings shows the interconnection of a flat top channel V-beam with insulated panels.

FIG. 21 of the drawings shows the interconnection of a flat top channel V-beam 50 with insulated panels 102. The panels 102 may be held in place by screws driven through the wings 40 of the beam 50, friction, adhesive, or the physical shape of the surrounding building structure.

Figure 22:
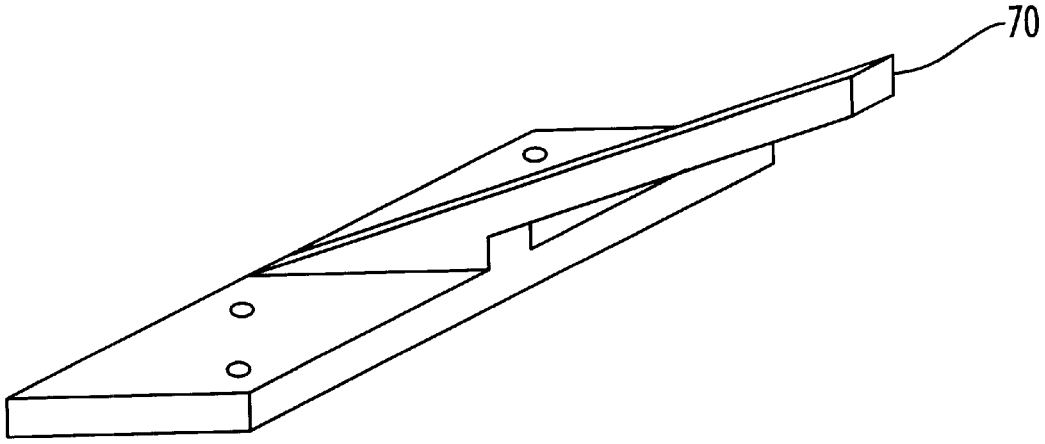
FIG. 22 shows a straight wall stud rafter-stud channel connecting block.
Figure 23:
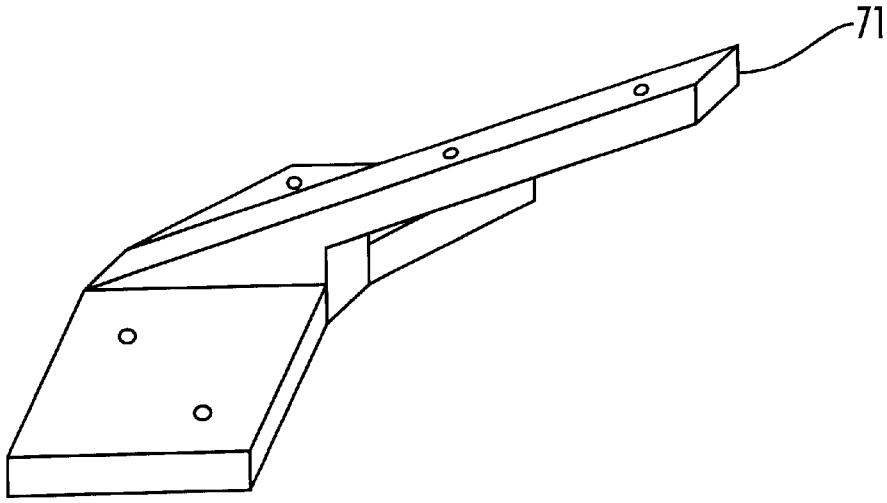
FIG. 23 shows a curved wall stud rafter-stud channel connecting block.
Figure 24:
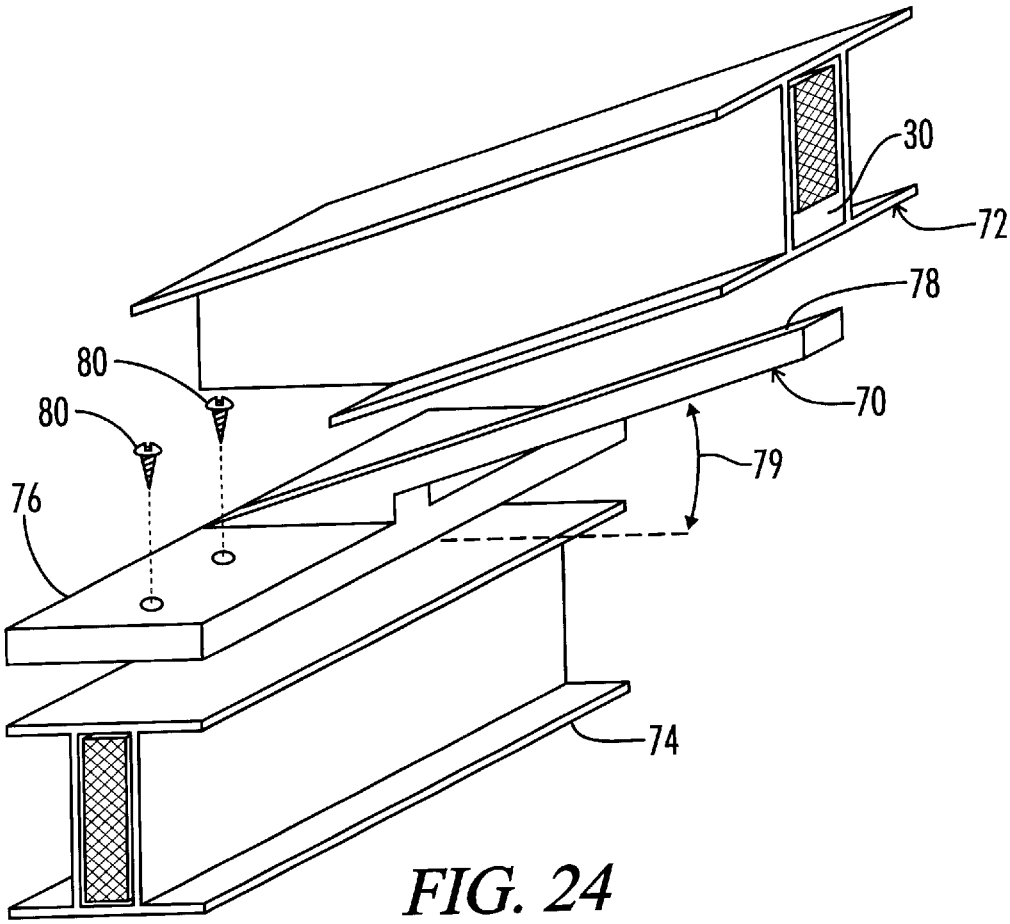
FIGS. 24 and 25 of the drawings show the interconnection of the rafter-stud channel connecting block with the wall and the rafter.
Figure 25:
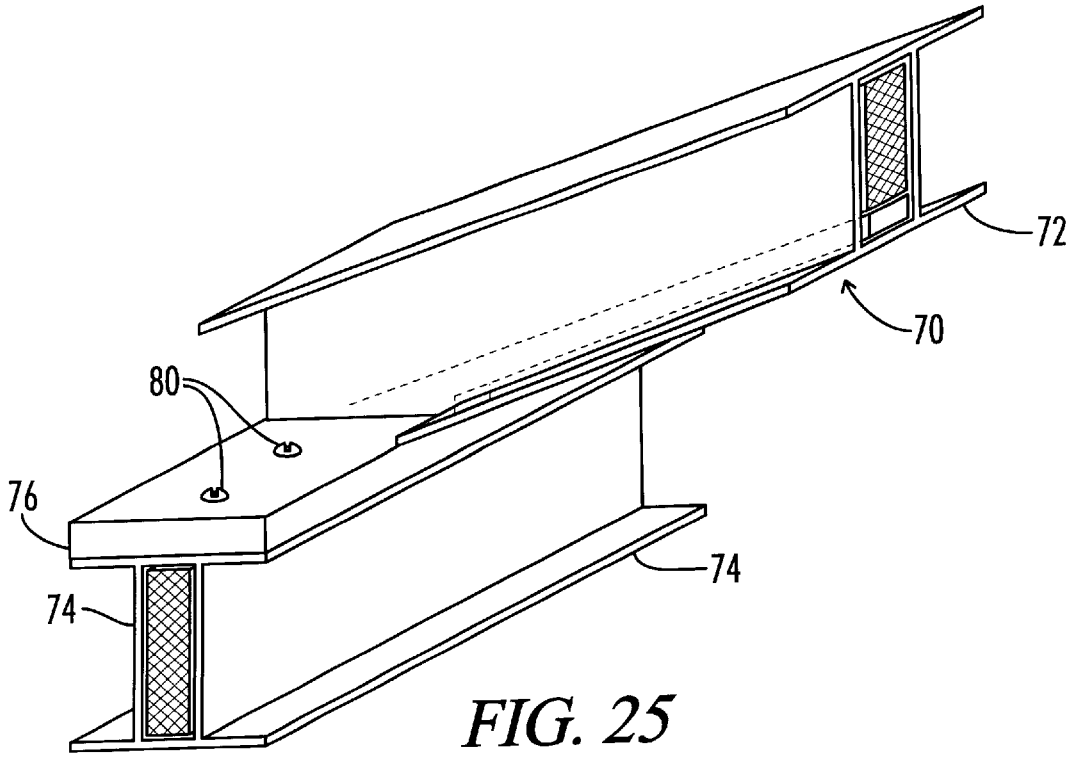

FIG. 22 shows a straight wall stud rafter-stud channel connecting block 70, and FIG. 23 shows a curved wall stud rafter-stud channel connecting block 71. These blocks are used to connect the roof rafters to the wall studs and their associated top plate. FIGS. 24 and 25 show the connection of a straight rafter-stud channel connecting block 70 to a roof rafter 72 and wall stud top plate 74. The straight channel connecting block 70 utilizes a base 76 which is screwed into center aperture 30 of the wall stud top plate 74. The embodiment shown utilizes screws 80 as an attachment means for connecting the connecting block 70 to the wall stud top plate 74. A pointed V-plane top or a flat bottom V-plane top plate can be utilized for the connecting block to connect to the wall stud top plate 74 and the rafter 72. The top 78 of the connecting block 70 mates inside the center aperture 30 of the roof rafter 72 profile. The connecting block 70 may also be attached with screws 80.

The connecting block 70 is shown in one preferred embodiment as utilizing a top 78 with a pitch angle 79 for connection to the pitch angle of the roof rafter 72. The top 78 profile is designed to slip into the center aperture 30 of the rafter 72 and use burrs or other frictional means for retaining the connection. A simple slot in the bottom of the roof rafter allows the rafter to overhang if an end opening for the center aperture is not available. A similar style of insert connection may be used for connection to the wall stud top plate or even a direct connection into a wall stud. Another alternative embodiment could use attachment arms that can be crimped to engage the wings 40 of the wall stud top plate 74 or the roof rafter 72. By utilizing the frictional engagement or the crimp engagement, no additional connectors would be necessary for connecting the stud top plate 74 to the rafter 72 with the rafter-stud block 70.

Figure 26:
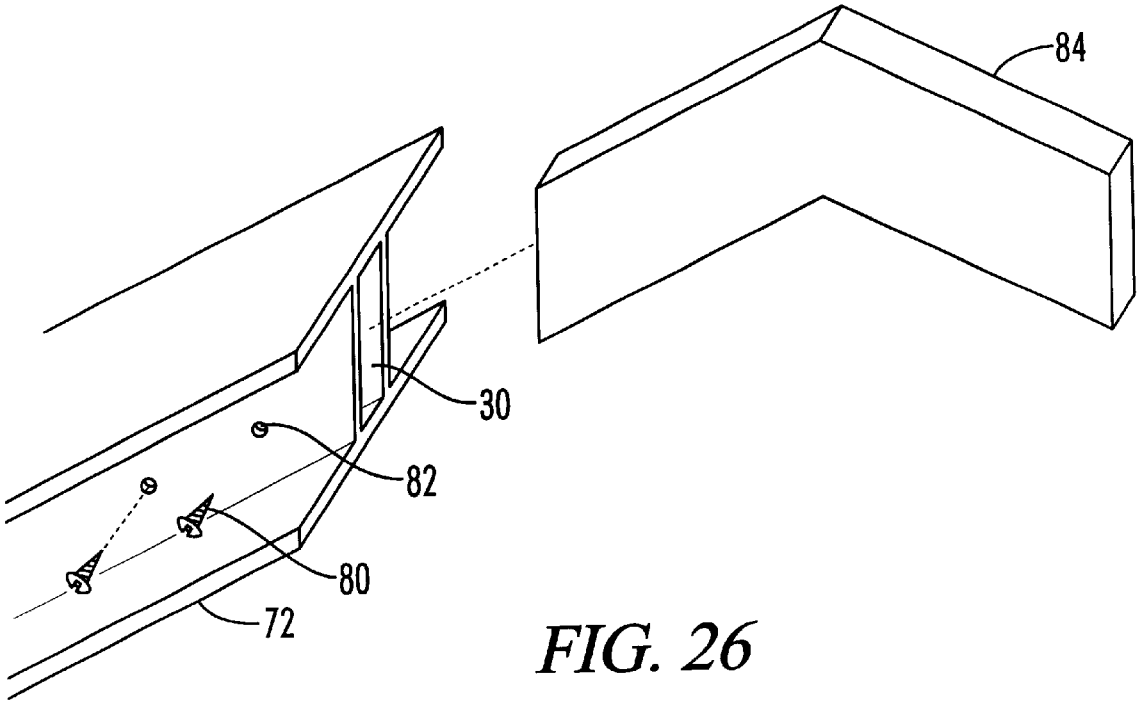
FIGS. 26–28 of the drawings show the rafter-rafter channel connecting block.
Figure 27:
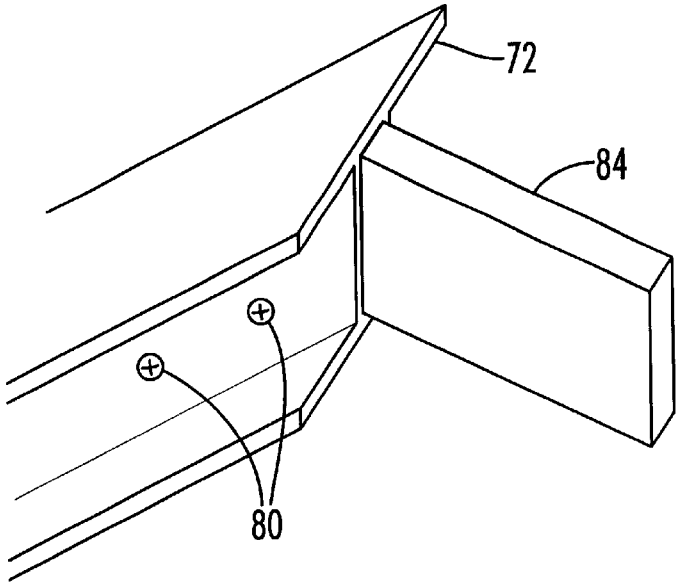
Figure 28:
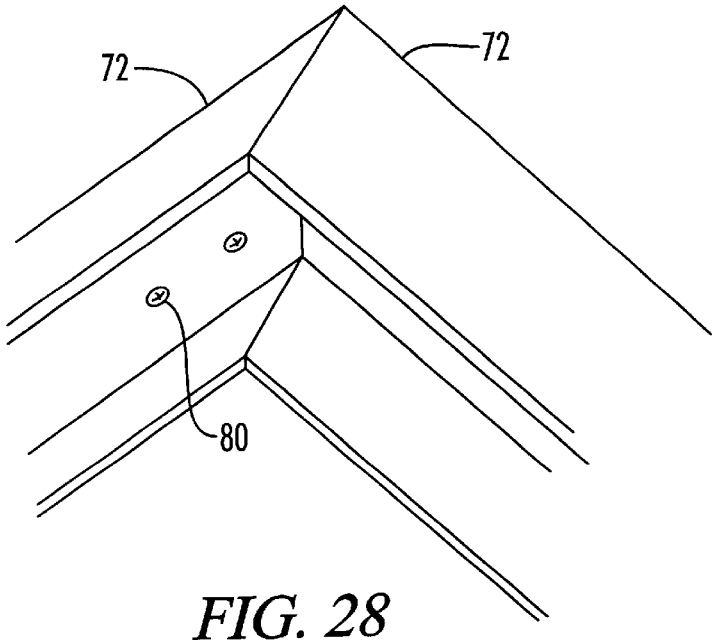

FIGS. 26 through 28 show the rafter channel connecting block 84 and the method for connecting rafters 72 together. The rafter channel connecting block 84 is inserted into each of the rafters 72 and secured with screws 80. As previously noted for the rafter-stud connecting block 70, the rafter-rafter connecting block 84 may also utilize a frictional or bur style of arrangement for connecting rafters 72 together. The use of adhesive is also anticipated for this connection.

Figure 29:
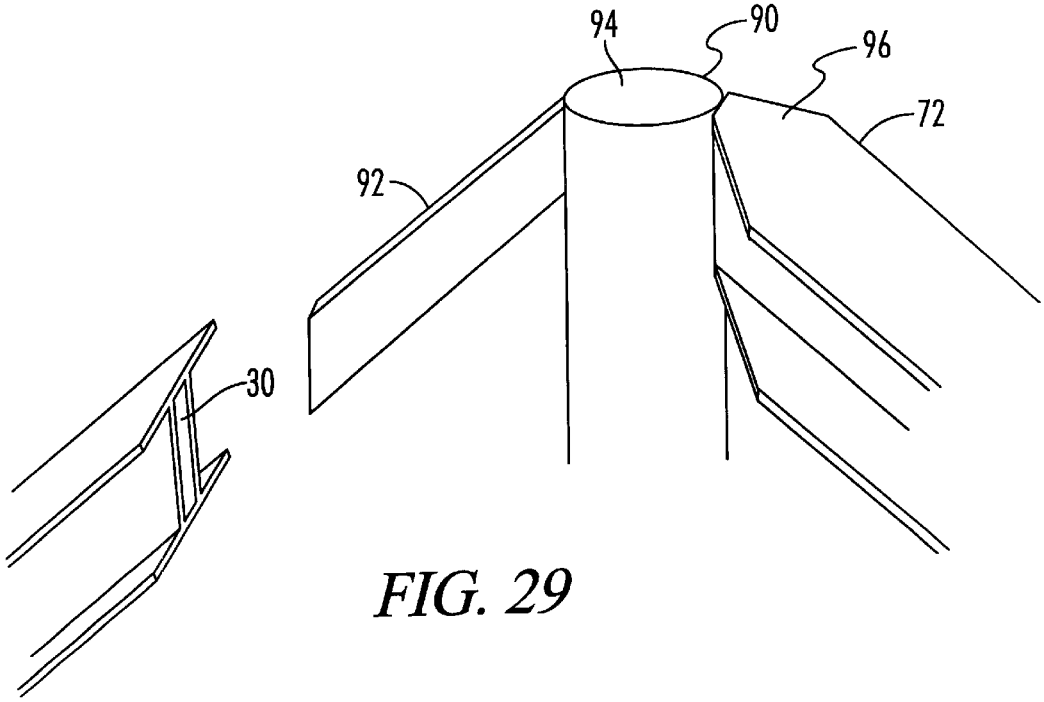
FIGS. 29–32 of the drawings show the multiple rafter spider connecting block.
Figure 30:
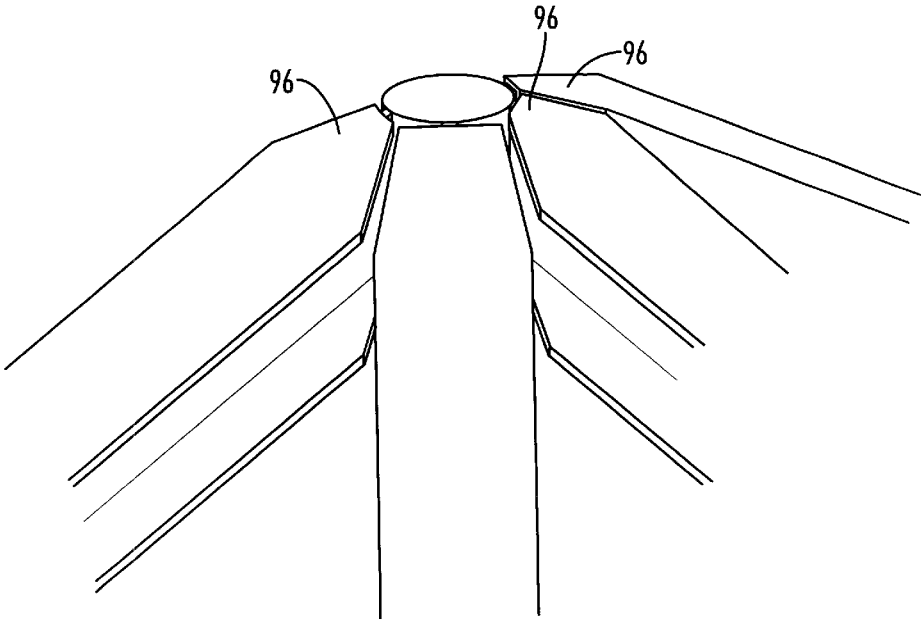
Figure 31:
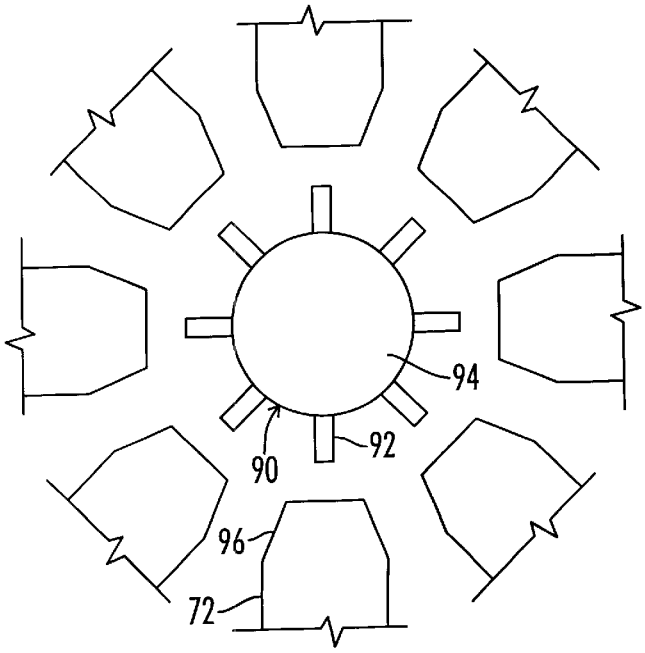
Figure 32:
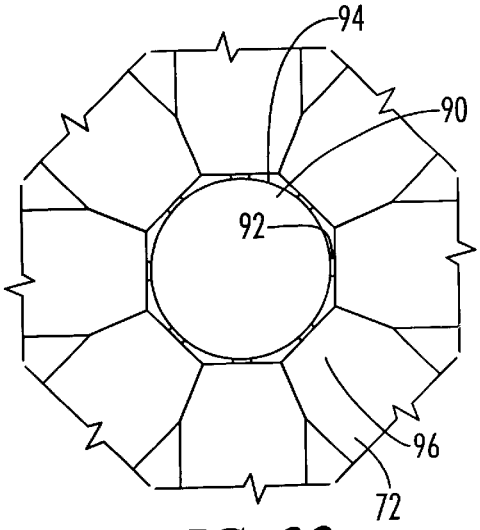

FIGS. 29 through 32 show the use of a multiple rafter spider connecting block 90 that is utilized to construct round roofing systems. This spider block 90 utilizes legs 92 that are inserted and secured into the center aperture 30 of the channel beams 20. These legs 92 may also be placed next to the vertical member 25 for constructing a round roofing system. FIG. 29 shows the use of the spider block 90 for connecting two rafters 72 together like a rafter-rafter connector 84. Note the angle-cut end 96 of the second rafter 72. This angle cut end is utilized when multiple rafters 72 are to be connected to the spider block 90 to form a rounded roof. As shown in FIG. 30, the angle cut ends 96 allow for multiple rafters 72 to be connected to a single spider block 90 to allow for the rounded roofs. FIGS. 31 and 32 show the connection of eight rafters 72 to a spider connecting block 90 for the formation of a round roof for a structure such as a gazebo.

This circular or rounded roofing apparatus 100 utilizes the connecting spider 90 and multiple channel beams 72 which are connected to the spider 90 and supported by the spider arms 92. The connecting spider includes a spider body 94 and can use any number of spider arms 92 to connect the channel beams 20 to the spider body 94. The preferred embodiment as shown utilizes eight spider arms 92 so that a gazebo style structure with eight roofing panels may be constructed. Note that the number of spider arms 92 will dictate the panel to panel angle across the roofing panels and thus, the wing angle of the channel beam 20. In addition, the pitch angle of the spider arms to the spider body will control the pitch angle of the roof once constructed. Thus, the number of spider arms 92, their location around the spider body 94, and the pitch angle of the spider arms 92 to the spider body 94 will control the style of roof to be built.

Figure 33:
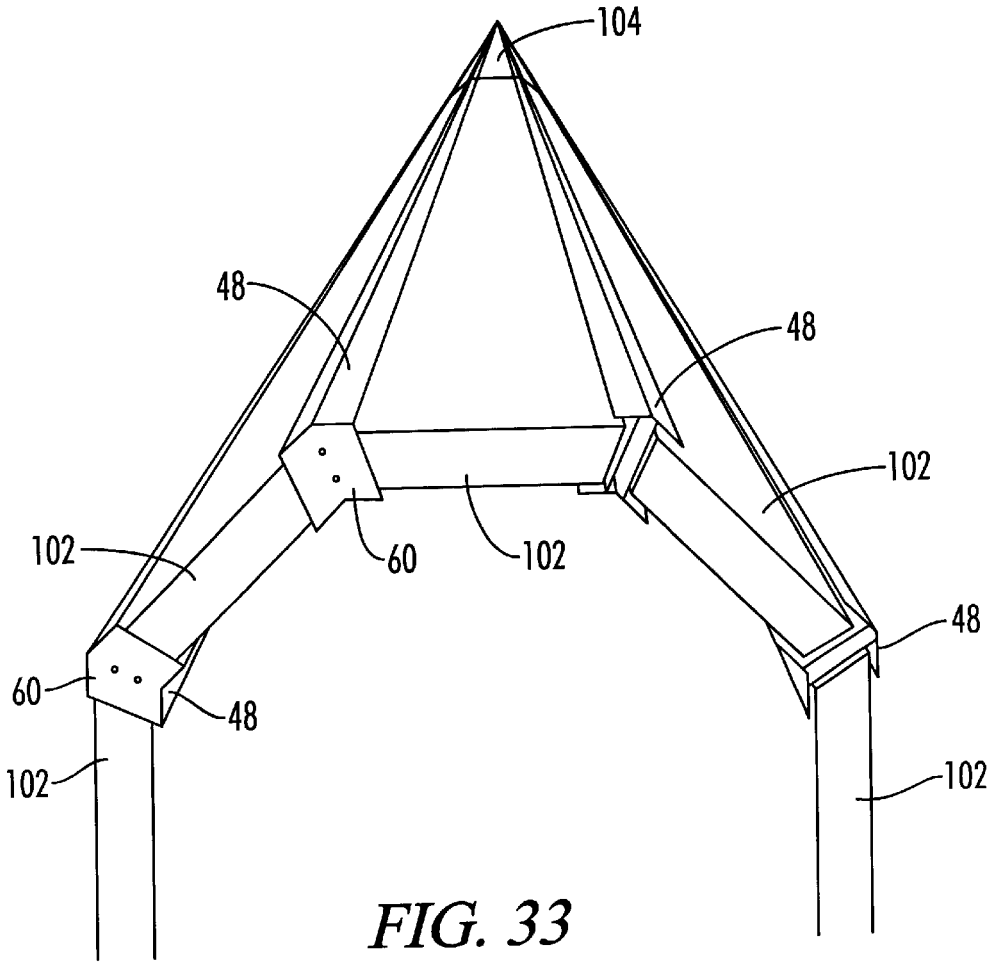
FIG. 33 of the drawings shows a circular roof with insulated panels.

The rounded roofing apparatus 100 shown in FIG. 33 is shown with pointed channel V-beams 48. It is also envisioned that other channel beams 20 such as I-beams, or channel I-beams, could be utilized for this construction. However, the preferred embodiment will utilize pointed channel V-beams 48.

As shown in FIG. 33, the rounded roofing apparatus 100 utilizes pointed channel V-beams 48 and each pointed channel V-beam 48 supports at least two roof panels 102. The wing angle 44 of each pointed channel V-beam 48 is associated with the roof curve angle between two roof panels 102. As illustrated, this configuration will utilizes eight roof panels 102, so the wing angle 44 will equal to forty-five degrees. Obviously, the pitch angle can be any angle. The pitch angle is usually chosen for aesthetic reasons, and may be influenced by local building codes or weather conditions. Each pointed-channel V-beam 48 that is connected to the spider 90 utilizes an angle-cut end 96 for the roof pitch angle, and the sides of the pointed channel V-beams 48 are adapted for the roof curve angle. Note that a large spider connecting block 90 would allow for the rafters 72 to be cut only for the pitch angle. Furthermore, if the spider connecting arms 92 were of sufficient length, then the rafters 72 would not need to be cut for the pitch angle. Thus, a standard square end cut channel beam 20 could be utilized as a rafter 72 with any of the top structures 22 or bottom structures 28 to form a roofing system. However, the preferred embodiment utilizes the small connecting spider 90 and the angle-cut ends 96 as illustrated.

FIG. 33 shows the circular roof 100 utilizing pointed channel V-beams 48 and panels 101 shown as insulated panels 102 which are held in place by the end caps 60. The end caps are removed for illustrative purposes on the right side of the drawing. The pointed channel V-beams 48 are connected by a spider block 90 (not shown) and the connection to the spider block 90 is covered and secured by a roof connecting cap apparatus 104. This roof cap apparatus may be used for both round rooms and oval room construction. This roof connecting cap apparatus 104 includes an upper roof cap 106 and a lower roof cap 108. The lower roof cap 108 is adjustably connected to the upper roof cap 106 to clamp the spider 90 and rafter 72 assembly together and to finish off the inside look of the roof apparatus 100.

Figure 33A:
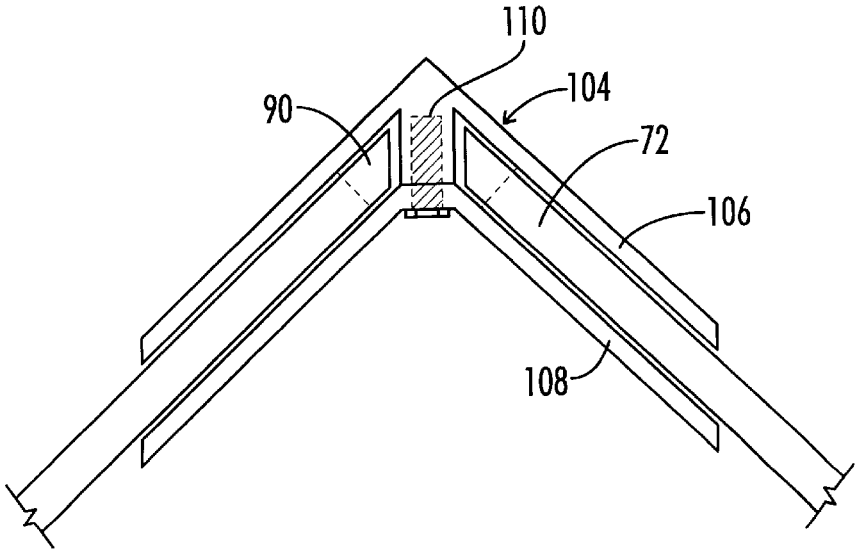
FIG. 33*a* of the drawings shows the connecting cap apparatus.

As shown in FIG. 33*a* of the drawings, the lower roof cap 108 and upper roof cap 106 form a clamping system for holding the roof rafters 72 and connecting spider 90 together as a unitary assembly. It is envisioned that connecting cap apparatus 104 could be designed to eliminate the spider connecting block 90 and only utilize the roof connecting cap assembly 104, but the preferred embodiment utilizes the spider connecting block 90 for additional strength. The lower roof cap 108 is connected to the upper roof cap 106 by a threaded connecting bolt 110. Alternative means for connection, including welding, clamping, fictional engagement, and mating connectors are also envisioned for this connection. The roof connecting cap apparatus 104 may also include an electrical connection through the lower roof cap 108 for an internal electrical fixture.

Figure 34:
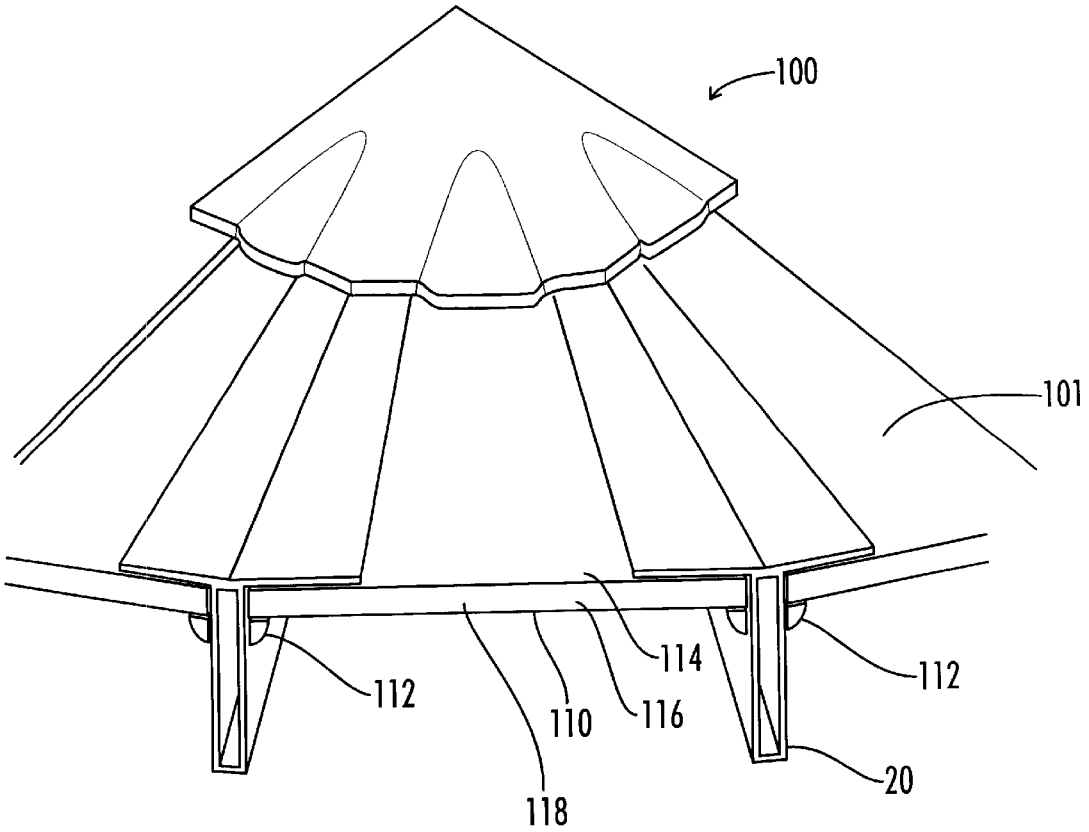
FIG. 34 of the drawings shows a circular roof with poly-carbonate panels.

FIG. 34 of the drawings shows a circular style roof 100 with panels 101 shown as ploy-carbonate panels 110. These poly-carbonate panels 110 may be clear to allow for the utilization of the roof apparatus 100 for a sun room or greenhouse. These thinner panels 110 may be held in place by a quarter round sealing bead 112 as shown in the drawings, or it is also envisioned that bead wings 40 could be molded with the vertical members 25 of the channel beam 20. Thus, the roofing apparatus may include a channel beam 20 with a roof panel 101 interlocked with the channel beam 20.

Different styles of panels 101 may be utilized in the roofing apparatus, including the insulated panels 102 and poly-carbonate panels 110 previously described, or alternatives such as glass panels and sheathing panels including both aluminum and polyvinyl-chloride. These panels 101 may be light permeable to allow for skylights, sunrooms, or green house construction, or the panels 101 may include insulated panels 102 for thermal efficiency. A mixture of panels 101 may be used for varying the different effects of each style of roof.

Figure 45:
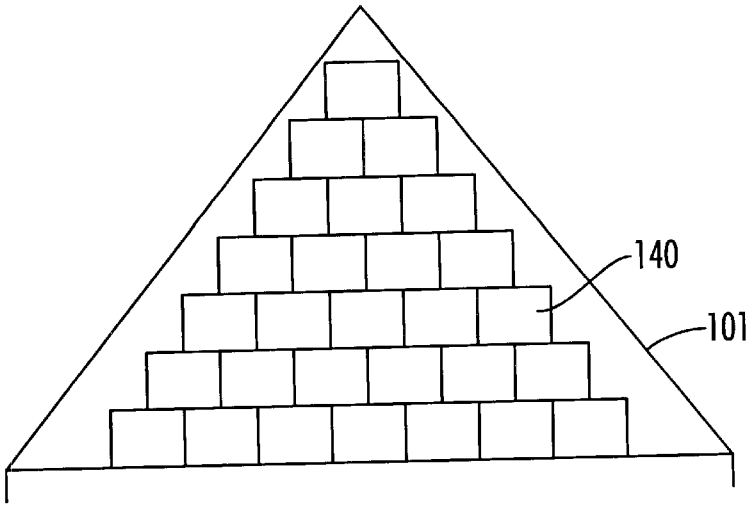
FIGS. 45–47 of the drawings show an embossed roof panel configuration.

The preferred insulated panel 102 is constructed from poly-vinyl chloride sheathing 114 with polystyrene 116 adhesively laminated to provide insulation for the insulated panel 102. The panel edges 118 may be covered with a fascia cap 122, or the sheathing 114 may wrap around the edges 118 of the panel 102 so that the sheathing 114 continuously covers two adjoining surfaces of the panel 102. Further adaptations may be made to the various styles of panels 101 by including a faux shingle appearance as shown in FIG. 45.

Figure 35:
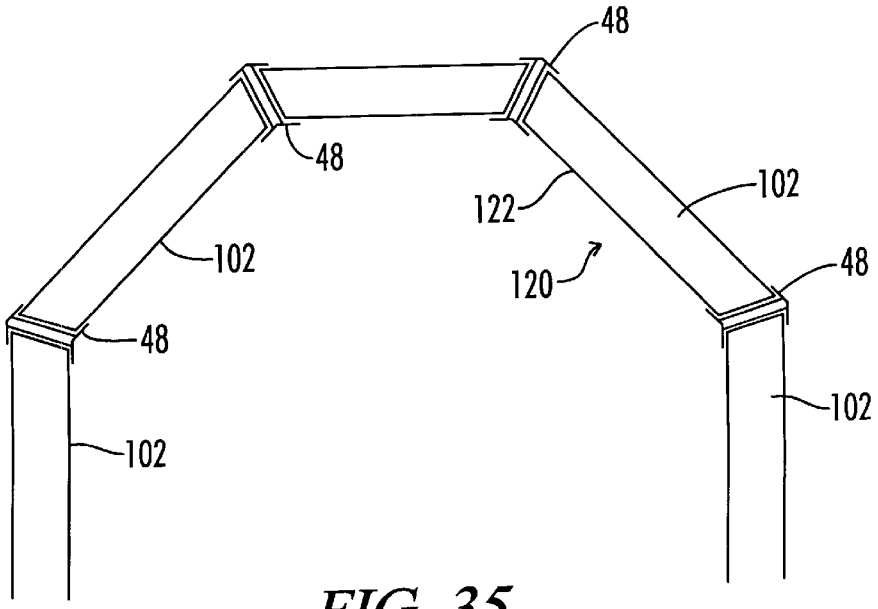
FIG. 35 of the drawings shows a circular insulated wall and stud configuration.
Figure 36:
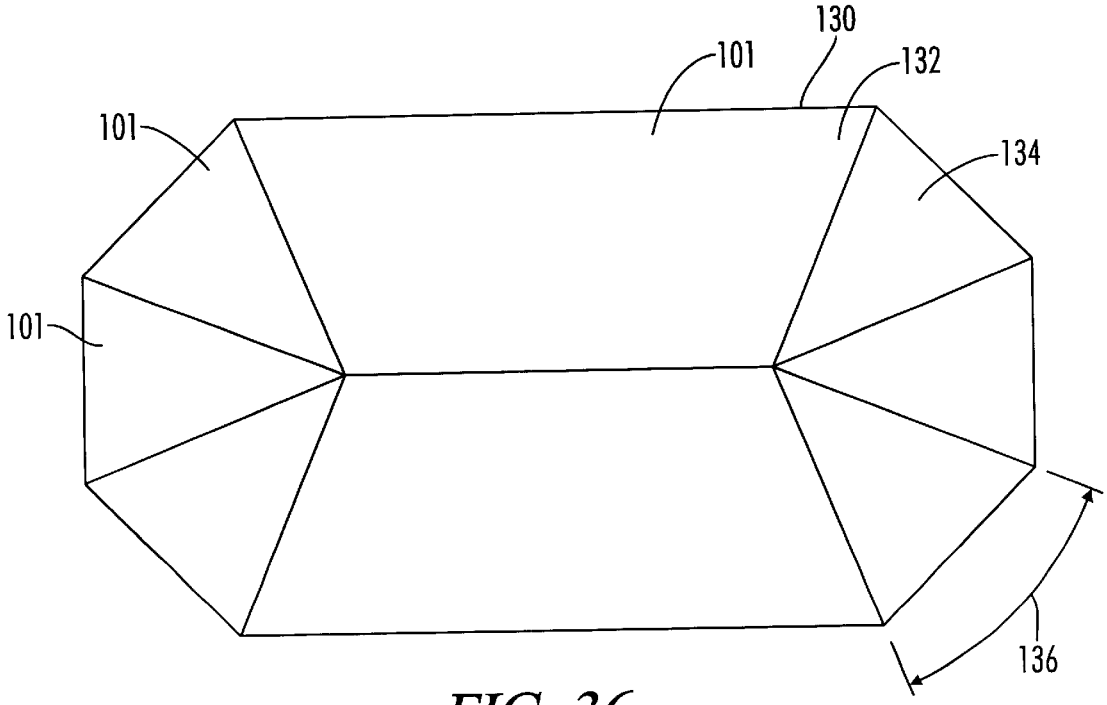
FIGS. 36–44 of the drawings show an oval room configuration.
Figure 37:
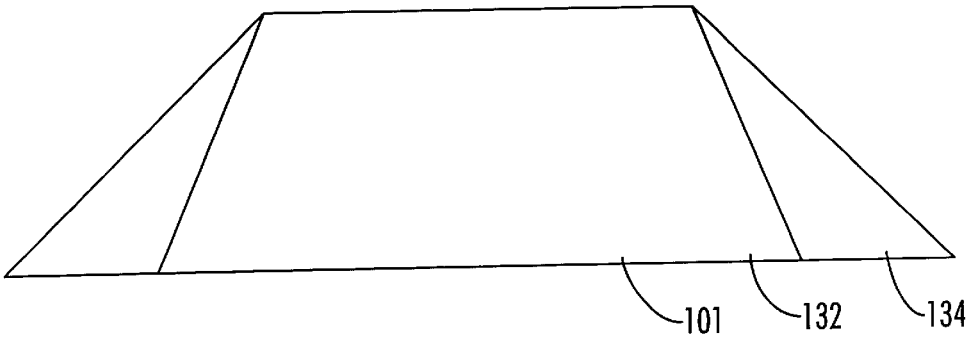

FIG. 35 shows the construction of a circular room configuration 120 with insulated walls 122 formed from insulated panels 102 and pointed channel V-beams 48. The preferred embodiment seals the panel to wall connection with silicon adhesive although any suitable adhesive may be used.

FIGS. 36–44 show the oval room configuration 130. In this embodiment, an oval roof apparatus 130 is constructed from eight panels 101. These panels 101 include two side panels 132 and six end panels 134. The roof panel angle 136 is forty five degrees, and any pitch may be utilized for the roofing apparatus as previously discussed.

Figure 38:
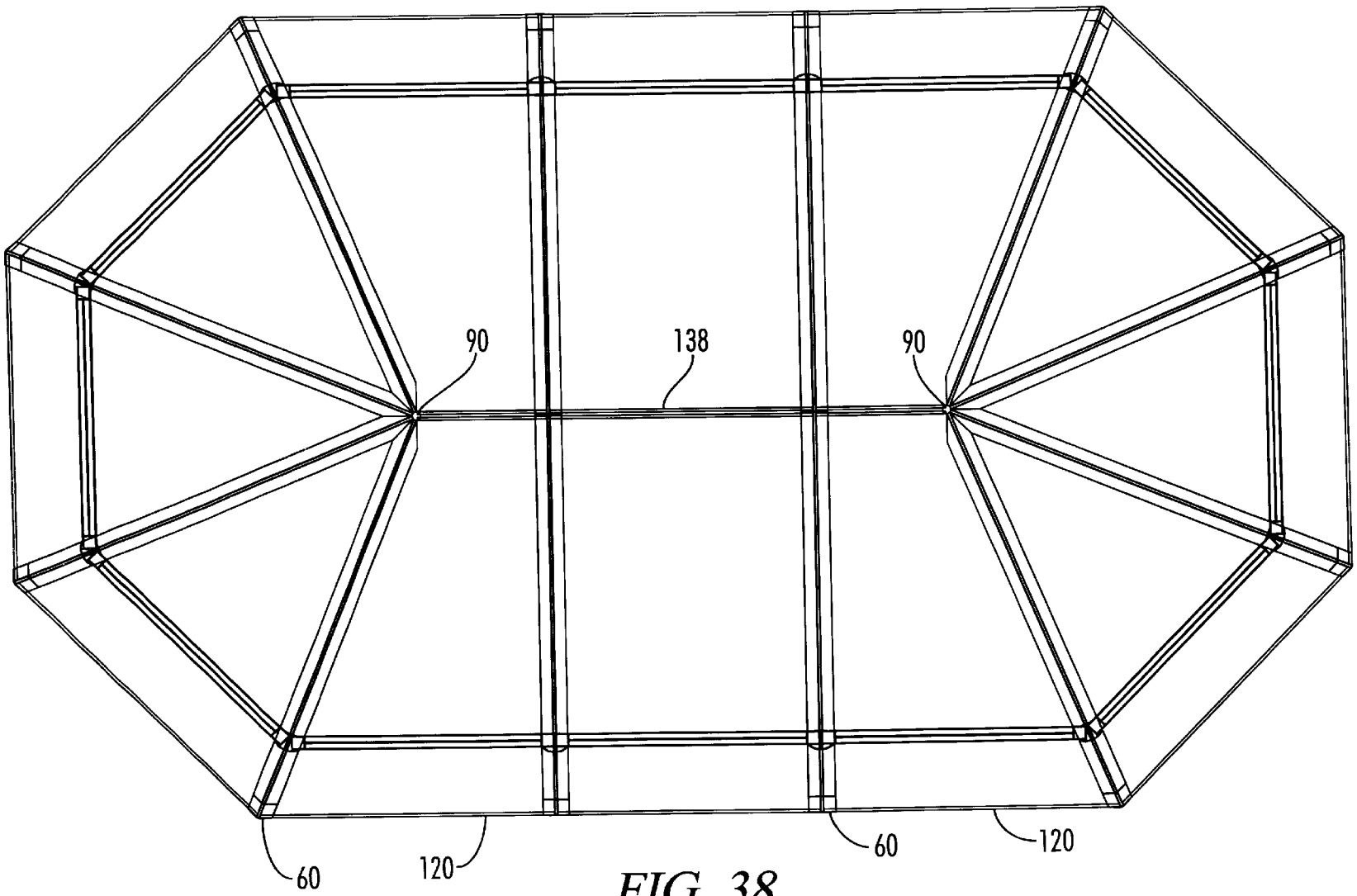

An oval room utilizes a spider connecting block 90 at each end of the oval room to form a rounded end for each end of the oval room. Then a connecting rafter 72 will be utilized between the two spider blocks 90 to form the center of the oval room. Fascia caps 120 are shown mounted on the edges of the roof panels 101, and retainer caps 60 are shown on the ends of the channel beams 20. As shown in FIG. 38 of the drawings, two spider connecting blocks 90 are utilized to construct an oval room. Each spider connecting block 90 utilizes five arms 92, four arms to form the rounded roof for each end, and one arm to support the central rafter header 138.

Figure 39:
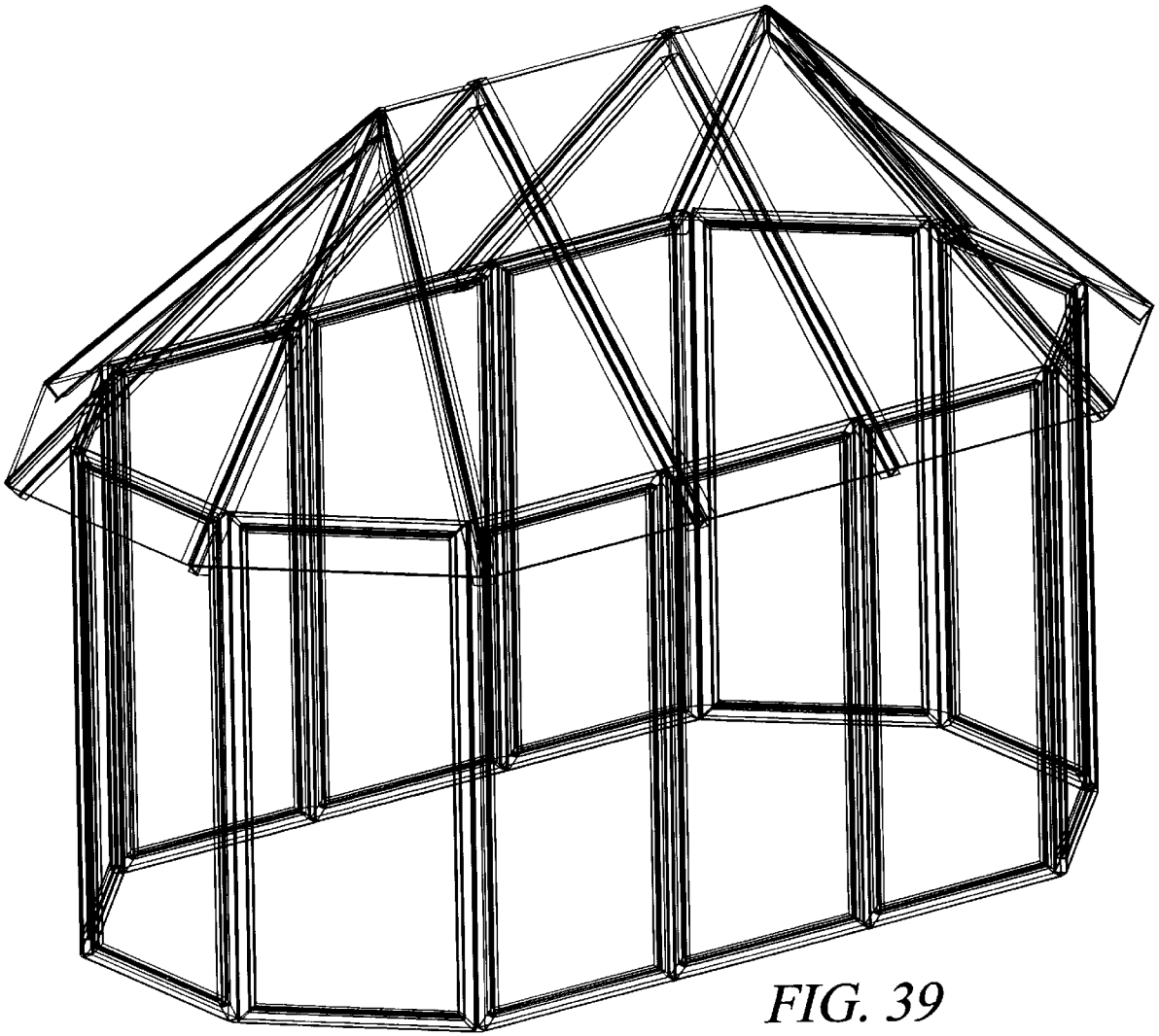
Figure 40:
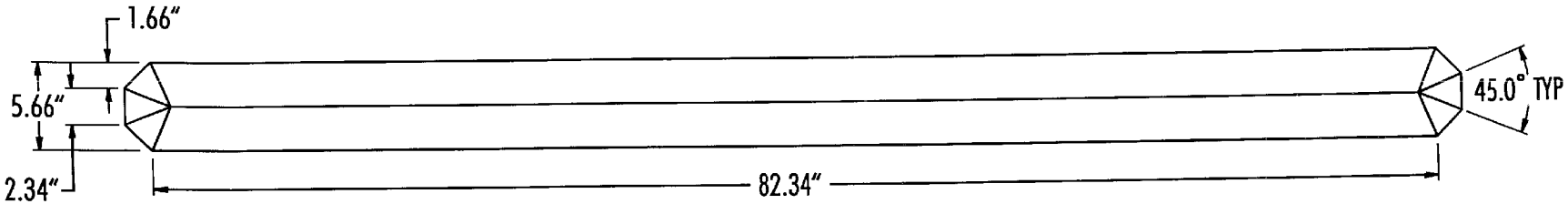
Figure 41:
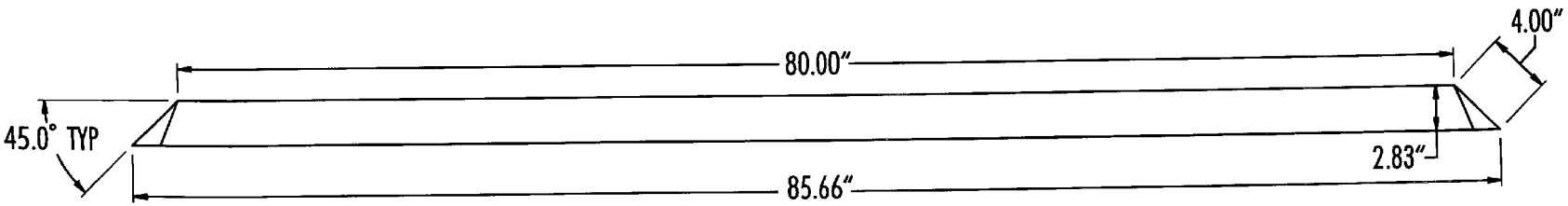
Figure 42:
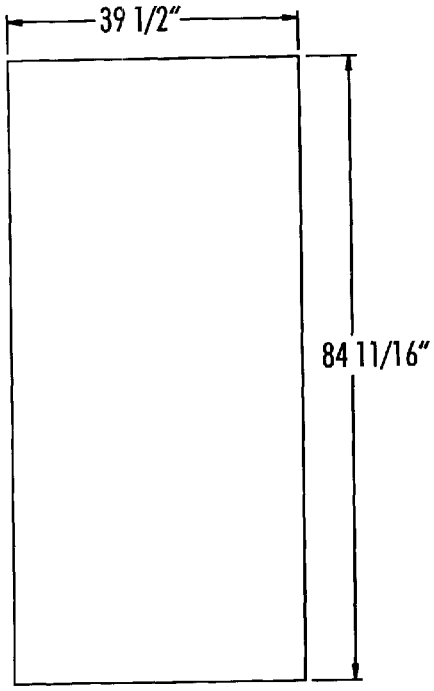
Figure 43:
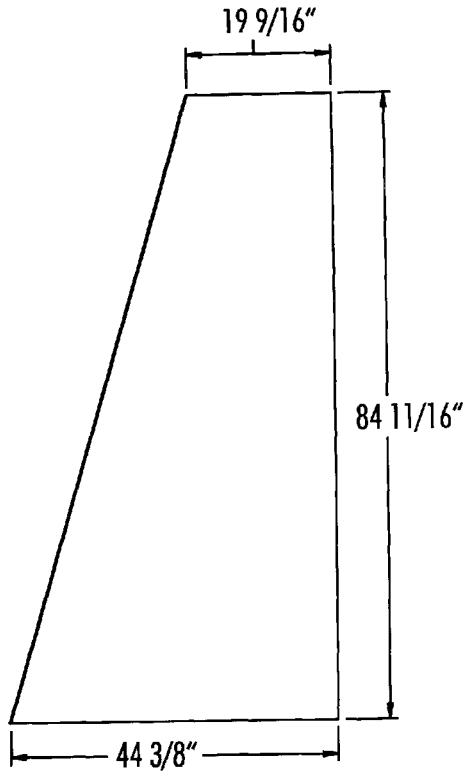
Figure 44:
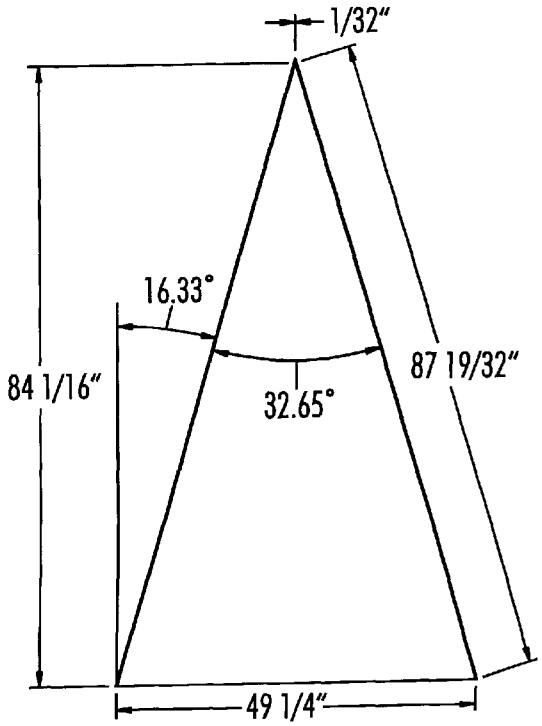

FIG. 39 shows an isometric view of the oval room 130 frame construction. Note that the central rafter header 138 has not been used in this embodiment of the design, and that the roof connecting cap apparatus 104 is not shown. Clear panels 101 have been drawn in for both the roof and side wall structure. FIGS. 40 and 41 show the upper roof cap 104 for this embodiment, and FIGS. 42–44 show the various roof panel 101 configurations used for the construction. This embodiment has utilized both angled and rectangular side panels 101 to illustrate another style or embodiment for the roofing system. As shown by FIGS. 42–44, an oval room uses three different roof panel shapes and a round room uses only one roof panel shape.

Figure 46:
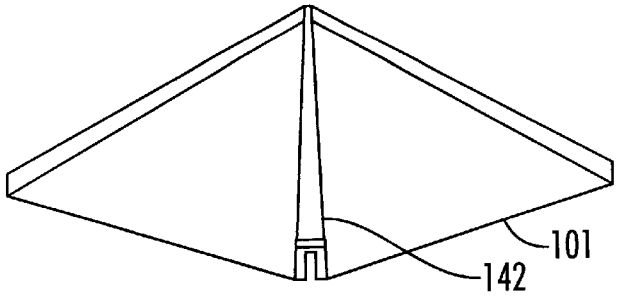
Figure 47:
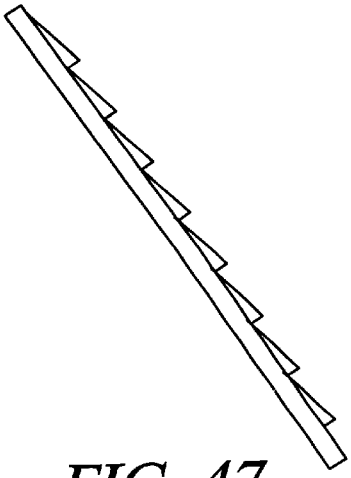

FIGS. 45 and 47 show the roof panel 101 with embossing 140 with a shingle pattern formed into the vinyl. FIG. 46 shows two inverted panels 101 connected with a C-channel 142.

Figure 48:
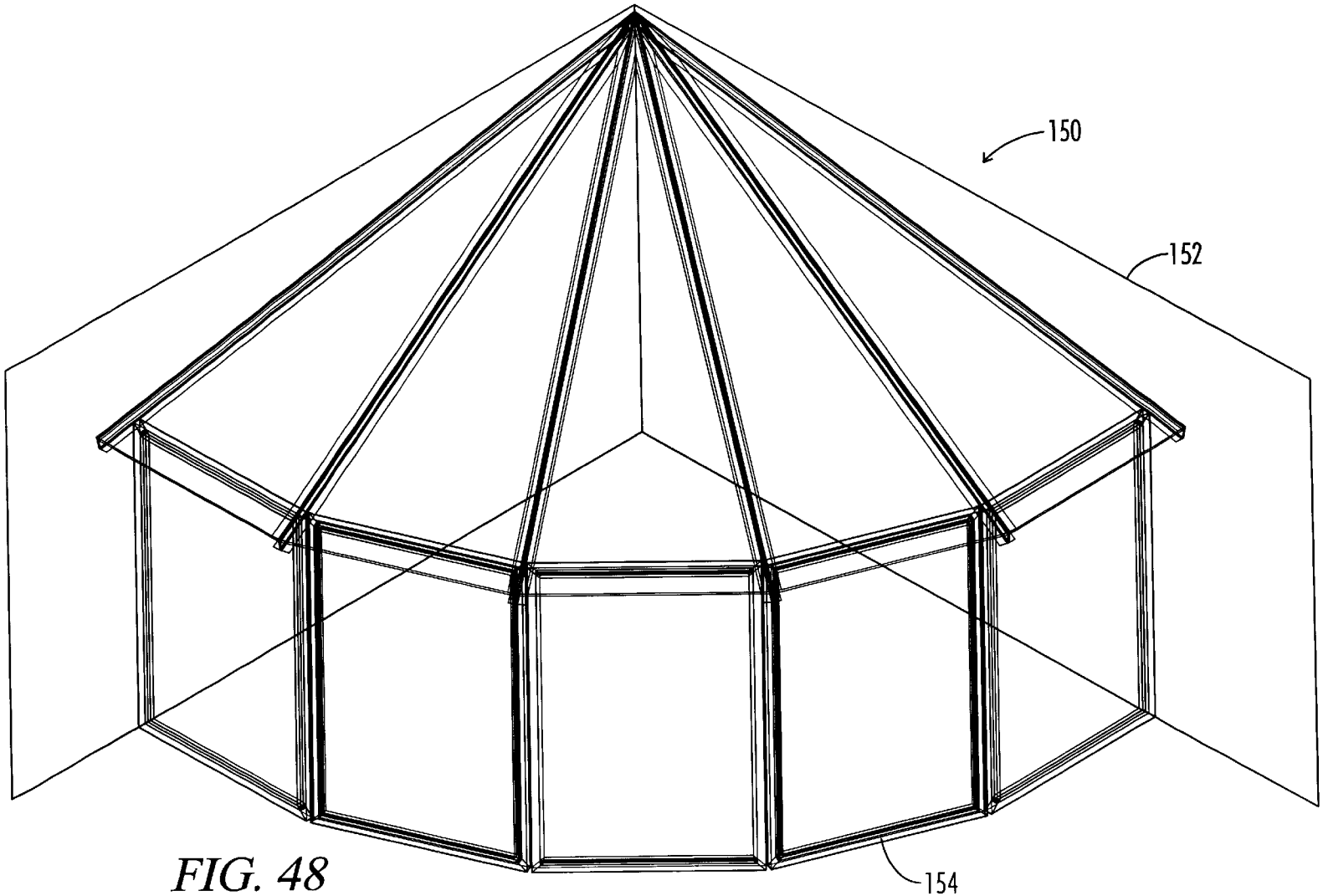
FIG. 48 of the drawings shows a partial oval room configuration.

FIG. 48 shows a partial oval room configuration 150. The channel beams 20 on each end have been modified to form channel C-beams 142 for flush mounting with the walls 152. The underlying walls 154 have been shown using conventional frame style construction.

Figure 49:
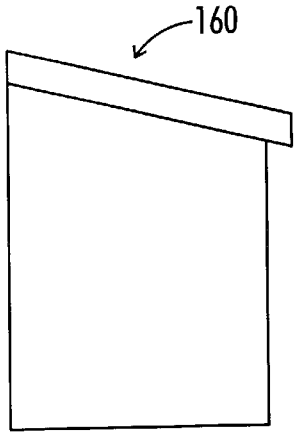
FIGS. 49–51 of the drawings show a shed and gable roof configurations for the present invention.
Figure 50:
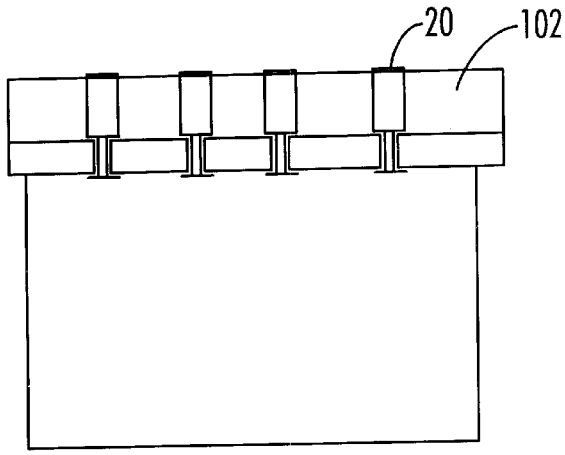
Figure 51:
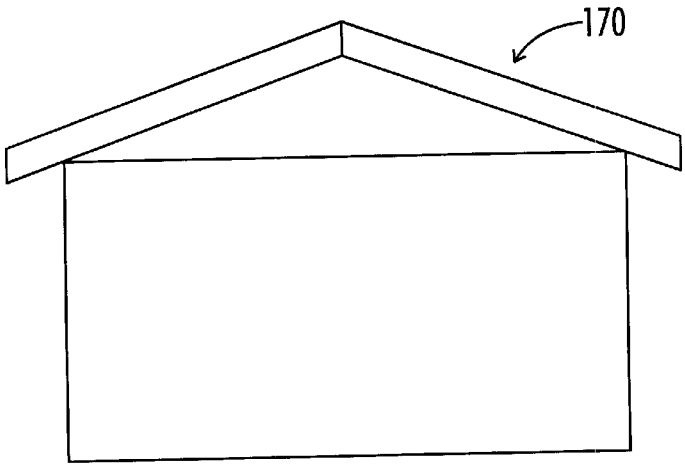

FIGS. 49 and 50 show the use of channel beams 20 with flat insulated sheathing panels 102 for the construction of a shed style roofing system 160, and FIG. 51 shows the end view of the gable style construction 170.

Thus, although there have been described particular embodiments of the present invention of a new and useful Vinyl I-beam Roofing System and Method, it is not intended that such references be construed as limitations upon the scope of this invention except as set forth in the following claims.

What is claimed is:

1. A roofing apparatus, comprising:

an aperture channel beam; and a roof panel interlocked with said aperture channel beam.

2. The roofing apparatus of claim 1, wherein said roof panel includes sheathing.

3. The roofing apparatus of claim 2, wherein said sheathing includes polyvinyl-chloride.

4. The roofing apparatus of claim 2, wherein said sheathing is light permeable.

5. The roofing apparatus of claim 2, wherein said sheathing includes poly-carbonate.

6. The roofing apparatus of claim 1, Therein said roof panel includes an insulated panel.

7. The roofing apparatus of claim 6, wherein said insulated panel includes sheathing adhesively laminated to insulation.

8. The roofing apparatus of claim 7, wherein said insulation includes polystyrene.

9. The roofing apparatus of claim 1, wherein said roof panel includes a fascia cap.

10. A rounded roofing apparatus, comprising:

a connecting spider; and multiple aperture channel beams connectively supported by said spider.

11. The rounded roofing apparatus of claim 10, wherein said connecting spider includes a spider body with multiple spider arms for connectively engaging said channel beams.

12. The rounded roofing apparatus of claim 10, wherein said multiple channel beams are V-beams.

13. The rounded roofing apparatus of claim 10, wherein each V-beam supports at least two roof panels; and each V-beam has a wing angle associated with the roof curve angle between two roof panels.

14. The rounded roofing apparatus of claim 10 wherein each beam is adapted for the roof pitch angle.

15. The rounded roofing apparatus of claim 10, wherein each beam is adapted for the roof curve angle.

16. An aperture channel beam apparatus, comprising:

a top structure;

a plurality of vertical members engaging said top structure; and a bottom structure engaging said plurality of vertical members, wherein said plurality of vertical members are inwardly disposed from the outer edges of the top structure to form a central aperture, and wherein said channel beam is a V-beam, said top structure is an upper V and said bottom structure is a lower V.

17. A covered-aperture channel beam apparatus, comprising:

an aperture channel beam apparatus, including a top structure, a plurality of vertical members engaging said top structure, and a bottom structure engaging said plurality of vertical members, wherein said plurality of vertical members are inwardly disposed from the outer edges of the top structure to form a channel beam aperture; and a retainer cap for covering the channel beam aperture.

* * * * *